US007658085B2

(12) United States Patent
Ha et al.

(10) Patent No.: US 7,658,085 B2
(45) Date of Patent: Feb. 9, 2010

(54) MONOLITHIC AIR CONDITIONER

(75) Inventors: Jong Min Ha, Gyeongsangnam-do (KR); Seong Kyu Min, Changwon-si (KR); Tai Hoon Kim, Woolsan-si (KR); Won Suk Jang, Pusan-si (KR); Byeong gi Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 274 days.

(21) Appl. No.: 11/206,743

(22) Filed: Aug. 19, 2005

(65) Prior Publication Data

US 2007/0039342 A1 Feb. 22, 2007

(51) Int. Cl.
*F25D 23/12* (2006.01)

(52) U.S. Cl. ..... 62/262; 62/428; 62/507; 165/96; 165/99; 165/122

(58) Field of Classification Search ..... 62/262, 62/428, 507; 165/96, 99, 122
See application file for complete search history.

(56) References Cited

U.S. PATENT DOCUMENTS 3,165,053 A * 1/1965 Christie ..... 454/202
5,295,531 A * 3/1994 Tsunekawa et al. ..... 165/48.1
5,775,123 A * 7/1998 Wakayama et al. ..... 62/407
6,692,223 B2 * 2/2004 Ikeda et al. ..... 415/53.1
2002/0056282 A1 * 5/2002 An ..... 62/262

FOREIGN PATENT DOCUMENTS

JP 62-9032 A 1/1987

* cited by examiner

*Primary Examiner*—Frantz F Jules
*Assistant Examiner*—Azim Rahim
(74) *Attorney, Agent, or Firm*—Birch, Stewart, Kolasch & Birch, LLP

(57) ABSTRACT

A monolithic air conditioner includes a cabinet, an outdoor heat exchanger mounted on a rear-inner portion of the cabinet and spaced away from a sidewall of the cabinet, a guide member attached on a rear surface of the outdoor heat exchanger, and a fan assembly disposed in the cabinet to introduce the outdoor air. The guide member has an air exhausting guide unit and an air introduction guide unit extending from the air exhausting guide section.

11 Claims, 10 Drawing Sheets

MONOLITHIC AIR CONDITIONER

BACKGROUND OF THE INVENTION

1. Field of the Invention

The present invention relates to a monolithic air conditioner, and more particularly, to a monolithic air conditioner that is designed to prevent air, which is exhausted from the air conditioner to an outdoor side, from being reintroduced into the air conditioner together with outdoor air that is being introduced into the air conditioner by improving the structure of an air exit and an air intake.

2. Description of the Related Art

Generally, an air conditioner is operated as a refrigerant goes through a cooling cycle having a series of processes such as a compression process, a condensing process, an expanding process, and a vaporizing process. That is, after the refrigerant is compressed to a high temperature and pressure state, heat is discharged to an outer side by a condenser. Then, the temperature and pressure of the refrigerant are lowered as it goes through an expansion valve. Then, the refrigerant goes through the vaporizer to absorb heat and returns to the condenser.

Here, the compression, condensing and expansion processes are performed in an indoor unit of the air conditioner. The vaporizing process is performed by a blower fan and a heat exchanger.

Meanwhile, the air conditioner is generally classified into a monolithic air conditioner having indoor and outdoor units that are integrated and a sprit air conditioner having indoor and outdoor units that are spirited from each other. Particularly, the monolithic air conditioner is generated buried into an indoor wall such that a vaporizer is disposed facing an indoor side and a condenser is disposed facing an outdoor side.

FIG. 1 shows a typical monolithic air conditioner.

Referring to FIG. 1, a typical monolithic air conditioner 10 includes a cabinet 11 defining an outer appearance of the air conditioner, a front panel 12 mounted on an front portion of the cabinet 11 to allow the air to be introduced or exhausted, and an outdoor heat exchanger 13 mounted on a rear portion of the cabinet 11 to allow a refrigerant to be heat-exchanged with the outdoor air.

The monolithic air conditioner 10 further includes an indoor heat exchanger (not shown) for allowing the refrigerant to be heat-exchanged with the indoor air, an indoor fan (not shown) disposed between the indoor and outdoor heat exchangers to introduce the indoor air and exhaust the same to the indoor side, and an outdoor fan (not shown) for introducing and exhausting the outdoor air. The monolithic air conditioner 10 further includes a driving motor (not shown) for driving the indoor and outdoor fans, and a compressor (not shown) for compressing the refrigerant, and a shroud for guiding the flow of the outdoor air.

The air conditioner 10 is installed in a hole penetrating an indoor wall to allow the indoor and outdoor airs to be introduced and exhausted.

That is, the air conditioner 10 is installed such that the front portion is disposed facing the indoor side and the rear portion is disposed facing the outdoor side. The indoor air is introduced into the air conditioner 10 through the front portion, heat-exchanged with the refrigerant by the indoor heat exchanger, and exhausted to the indoor side through the front portion.

The outdoor air is introduced into the air conditioner 10 through the rear portion, heat-exchanged with the refrigerant by the outdoor heat exchanger, and exhausted to the outdoor side through the front portion.

Actually, the air conditioner 10 is installed in a housing (not shown) inserted in the hole.

The outdoor heat exchanger 13 mounted on the rear portion of the air conditioner 10 is exposed to the outdoor side. A rear end of the heat exchanger 13 is spaced away from a sidewall of the cabinet 11. A gap between the cabinet 11 and the outdoor heat exchanger 13 defines an outdoor air intake. Therefore, the outdoor air is introduced into the air conditioner through the outdoor air intake. The introduced air is exhausted to the outdoor side after passing through the outdoor heat exchanger 13.

Since there is no special member for dividing the outdoor air intake and the outdoor heat exchanger 13, the outdoor air that is exhausted after passing through the outdoor heat exchanger 13 may be reintroduced. That is, the air that is increased in a temperature while passing through the outdoor heat exchanger 13 is reintroduced into the air conditioner 10, thereby deteriorating the heat exchange of the air with the refrigerant flowing along the heat exchanger 13. As a result, the heat exchange efficiency of the air conditioner is deteriorated, thereby deteriorating the overall air-cooling efficiency.

SUMMARY OF THE INVENTION

Accordingly, the present invention is directed to a monolithic air conditioner that substantially obviates one or more problems due to limitations and disadvantages of the related art.

An object of the present invention is to provide a monolithic air conditioner that can improve the cooling efficiency by preventing first outdoor air, which is being introduced into the air conditioner, and second outdoor air, which is being exhausted out of the air conditioner, from being mixed with each other.

Another object of the present invention is to provide a monolithic air conditioner that can reduce a load of a fan motor by preventing airflow resistance from generating at an area between an outdoor air intake and an outdoor air outlet.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a monolithic air conditioner comprising: a cabinet; an indoor heat exchanger mounted on a front-inner portion of the cabinet; an outdoor heat exchanger mounted on a rear-inner portion of the cabinet and spaced away from a sidewall of the cabinet; a guide member comprising a mounting section coupled to the outdoor heat exchanger by a coupling member, an inclined section extending from the mounting surface 401 at a predetermined inclined angle to guide the airflow, and guide sections formed by bending upper and lower edges of the inclined surface; and a fan assembly disposed between the outdoor heat exchanger and the indoor heat exchanger.

According to another aspect of the present invention, there is provided a monolithic air conditioner comprising: a cabinet; an outdoor heat exchanger mounted on a rear-inner portion of the cabinet and spaced away from a sidewall of the cabinet; a guide member attached on a rear surface of the outdoor heat exchanger, the guide member comprising an air exhausting guide unit and an air introduction guide unit extending from the air exhausting guide section; and a fan assembly disposed in the cabinet to introduce the outdoor air.

According to still another aspect of the present invention, there is provided a monolithic air conditioner comprising: a cabinet defining an outer appearance of the air conditioner; an outdoor heat exchanger mounted on a rear-inner portion of the cabinet; and a guide member mounted to cover a portion of an outdoor air intake defined between the outdoor heat exchanger and the cabinet or a portion of the outdoor heat exchanger.

According to the present invention, the inventive monolithic air conditioner can improve the cooling efficiency and the heat exchange efficiency by preventing first outdoor air, which is being introduced into the air conditioner, and second outdoor air, which is being exhausted out of the air conditioner, from being mixed with each other.

Furthermore, the inventive monolithic air conditioner can reduce a load of a fan motor by preventing airflow resistance from generating at an area between an outdoor air intake and an outdoor air outlet, thereby saving the electric power.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
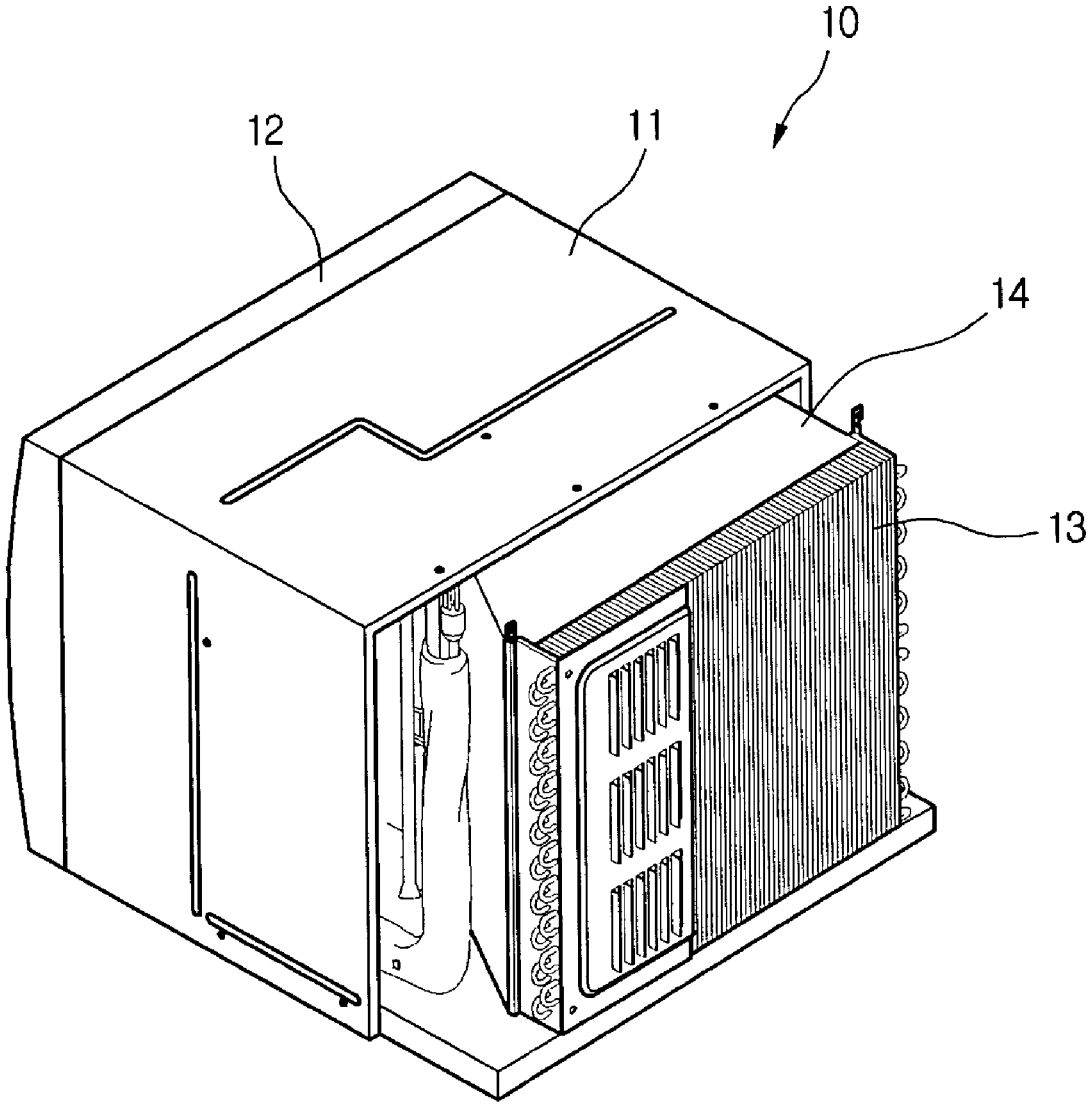
FIG. 1 is a perspective view of a related art monolithic air conditioner.
Figure 2:
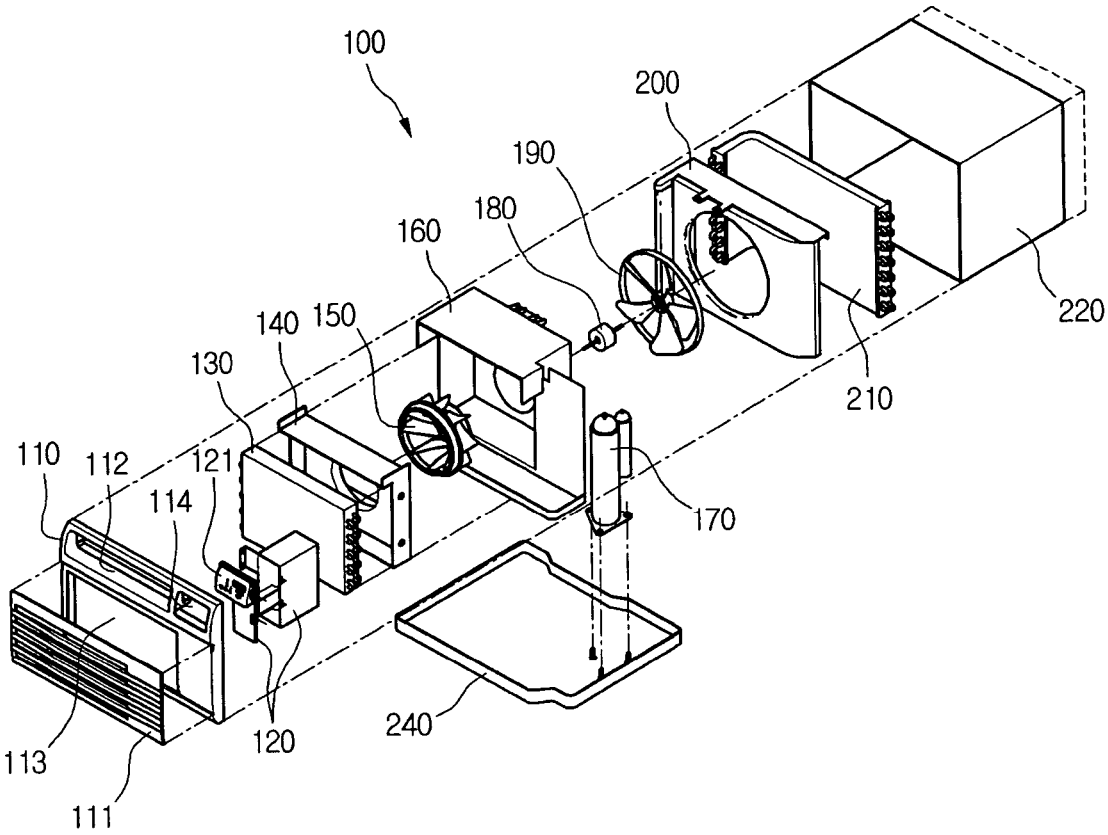
FIG. 2 is an exploded perspective view of a monolithic air conditioner according to a first embodiment of the present invention.
Figure 3:
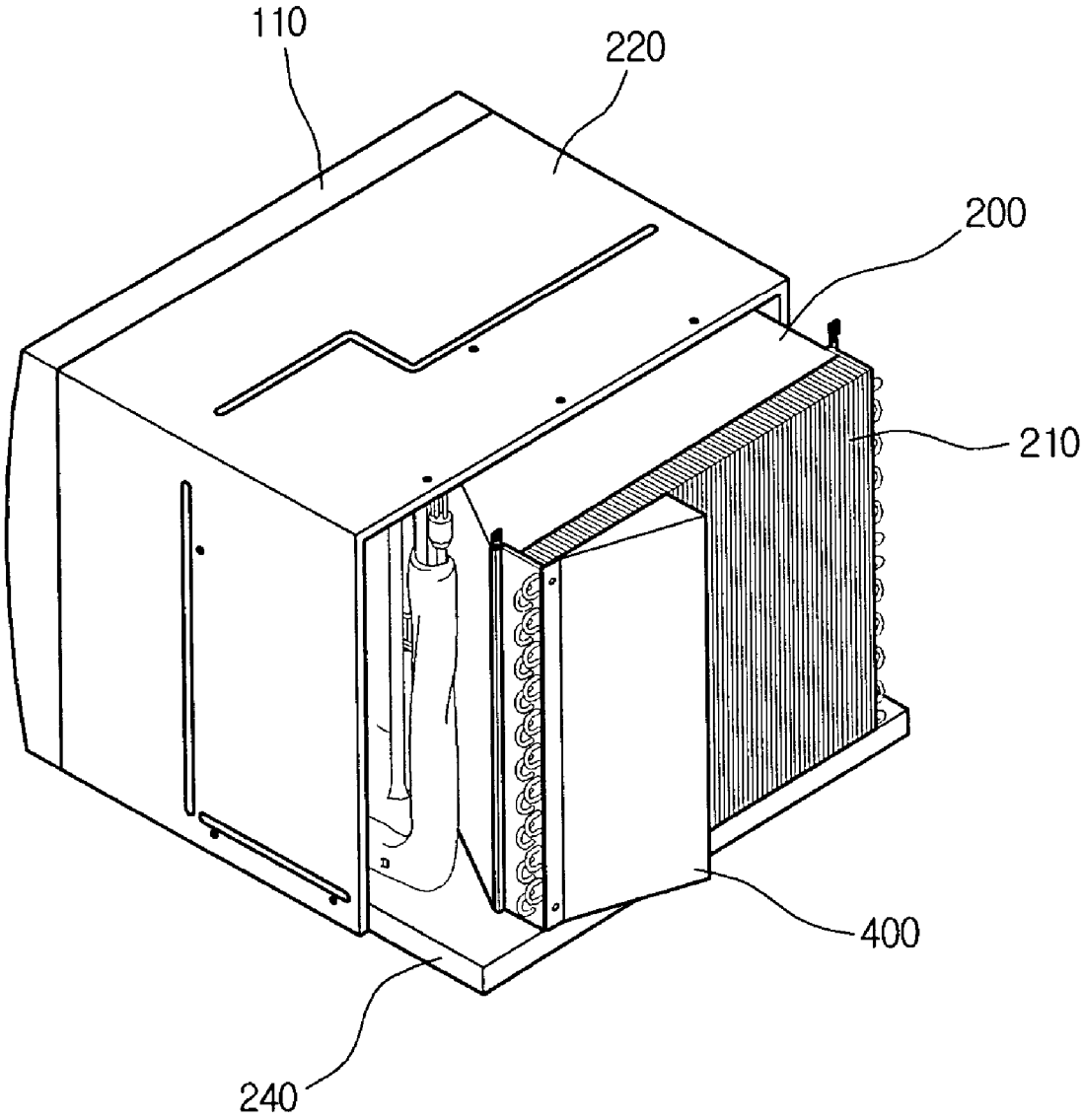
FIG. 3 is a perspective view of a monolithic air conditioner according to a first embodiment of the present invention.

FIGS. 2 and 3 show a monolithic air conditioner according to a first embodiment of the present invention.

Referring to FIGS. 2 and 3, a monolithic air conditioner 100 includes a cabinet 220 defining an outer appearance, a front panel 110 mounted on a front portion of the cabinet 220, a front grill 111 mounted on a front surface of the front panel 110 to guide airflow, an indoor heat exchanger 130 disposed in rear of the front panel 110 to allow introduced air to be heat-exchanged with a refrigerant, and a control body 120 disposed in rear of the front panel 110.

The front panel 110 is provided with an air intake 113 on which the front grill 111 is mounted to allow the air to be introduced into the air conditioner 100. The front panel 110 is further provided with an air outlet 112 above the air intake 113 to exhaust the air, which is introduced into the air conditioner and heat-exchanged with the refrigerant flowing along the indoor heat exchanger 130, out of the air conditioner. The front panel 110 is further provided with a display insertion hole 114. A variety of electronic components for controlling the operation of the air conditioner 100 are installed in the control body 120. A display unit 121 for displaying the operation state of the air conditioner 100 is mounted on a front surface of the control box 120 and inserted into the display insertion hole 114 of the front panel 110 so that a user can identify the operation state of the air conditioner 100.

The monolithic air conditioner 100 further includes an air guide 140 mounted in rear of the indoor heat exchanger 130, a scroll 160 located in rear of the air guide 140 to guide the exhaust of the introduced indoor air, a shroud 200 mounted in rear of the scroll 160 to guide the outdoor air that is being introduced, a fan motor 180 inserted in a center of the scroll 160, an indoor fan 150 shaft-connected to a front portion of the fan motor 180, and an outdoor fan 150 shaft-connected to a rear portion of the fan motor 180.

Describing in more detail, the air guide 140 is provided at a center with a hole to allow the indoor air introduced by the indoor fan 150 to be directed toward the scroll 160. The air guide 140 is connected to the air intake 113 of the front panel 110 to guide the air.

The monolithic air conditioner 100 further includes an outdoor heat exchanger 210 provided in rear of the shroud 200 to allow introduced outdoor air to be heat-exchanged with a refrigerant, a guide member 400 covering all or part of a rear surface of the outdoor heat exchanger 210 to guide the outdoor air that is being exhausted, a base 240 for supporting the above-described elements, and a compressor 170 fixed on the base 240 to compress the refrigerant.

The operation of the above-described monolithic air conditioner 100 will be described hereinafter.

When the air conditioner 100 is operated, the refrigerant stored in the compressor 170 is compressed with a high temperature and pressure. In addition, the fan motor 180 is operated to rotate the indoor and outdoor fans 150 and 190. The compressed refrigerant is directed to the outdoor heat exchanger 210. Then, when the outdoor fan 190 rotates, the outdoor air is introduced through the outdoor air intake. The introduced air is directed to the outdoor heat exchanger 210 through a hole formed on the shroud 200. The air directed to the shroud 200 is heat-exchanged with the refrigerant flowing along the outdoor heat exchanger 210 to be increased in a temperature and is then exhausted to the outdoor side. At this point, the guide member 400 guides the exhaust of the heat-exchanged air in a direction away from the outdoor air intake.

Meanwhile, the refrigerant flowing along the outdoor air exchanger 210 is lowered in the temperature by being heat-exchanged with the introduced outdoor air. Then, the refrigerant passes through an expansion valve (not shown) provided in the air conditioner 100 to be quickly lowered in the temperature and pressure. The refrigerant passed through the expansion valve is directed to the indoor heat exchanger 130. In addition, the indoor air is introduced into the air conditioner 100 through the front grill 111 by the rotation of the indoor fan 100. The introduced indoor air is lowered in the temperature while passing through the indoor heat exchanger 130. At this point, the refrigerant flowing along the indoor heat exchanger 130 is increased in the temperature by the heat exchanged with the introduced indoor air. Then, the air is directed to the scroll 160 via the air guide 140. The air directed to the scroll 160 is directed to the air outlet 112 of the front panel 110 along an air passage defined by the air guide 140 and the scroll 160. Then, the air is exhausted through the air outlet 112. The refrigerant passed through the indoor heat exchanger 130 is returned to the compressor 170.

Figure 4:
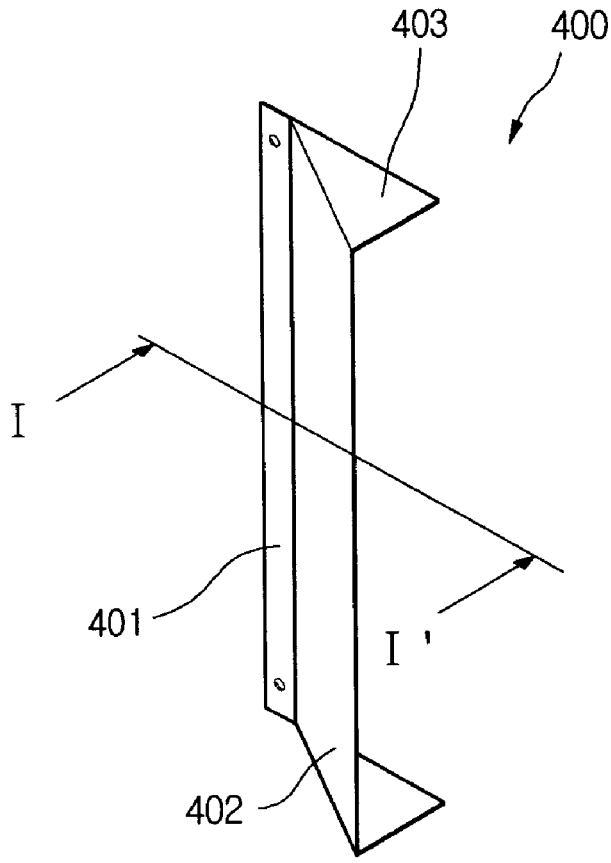
FIG. 4 is a perspective view of a guide member depicted in FIG. 2.
Figure 5:
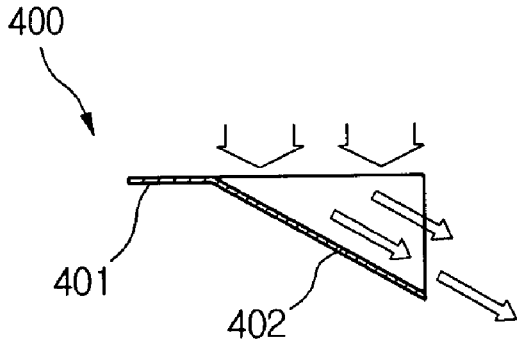
FIG. 5 is a sectional view taken along line I-I' of FIG. 4.

FIGS. 4 and 5 show the guide member 400.

Referring to FIGS. 4 and 5, the guide member 400 is mounted on a rear surface of the outdoor heat exchanger 210 to function to guide the exhaust of the air out of the air conditioner 100.

The guide member 400 includes a mounting section 401 coupled to the outdoor heat exchanger 210 by a coupling member, an inclined section 402 extending from the mounting surface 401 at a predetermined inclined angle to guide the airflow, and guide sections 403 formed by bending upper and lower edges of the inclined surface 402.

Describing in more detail, the guide member 400 is mounted on a side edge of the outdoor heat exchanger 210, which is adjacent to the outdoor air intake. The inclined section 402 extends from the mounting section 401 at a predetermined angle such that the air passed through the outdoor heat exchanger 210 can be exhausted in a direction away from the outdoor air intake. This is to prevent the first outdoor air, which is being introduced into the air conditioner, and second outdoor air, which is being exhausted out of the air conditioner, from being mixed with each other and introduced into the air conditioner 100. The guide sections 403 formed by bending the upper and lower edges of the inclined section 402 prevent the air, which is being exhausted, from leaking through upper and lower sides of the guide member 400.

Figure 6:
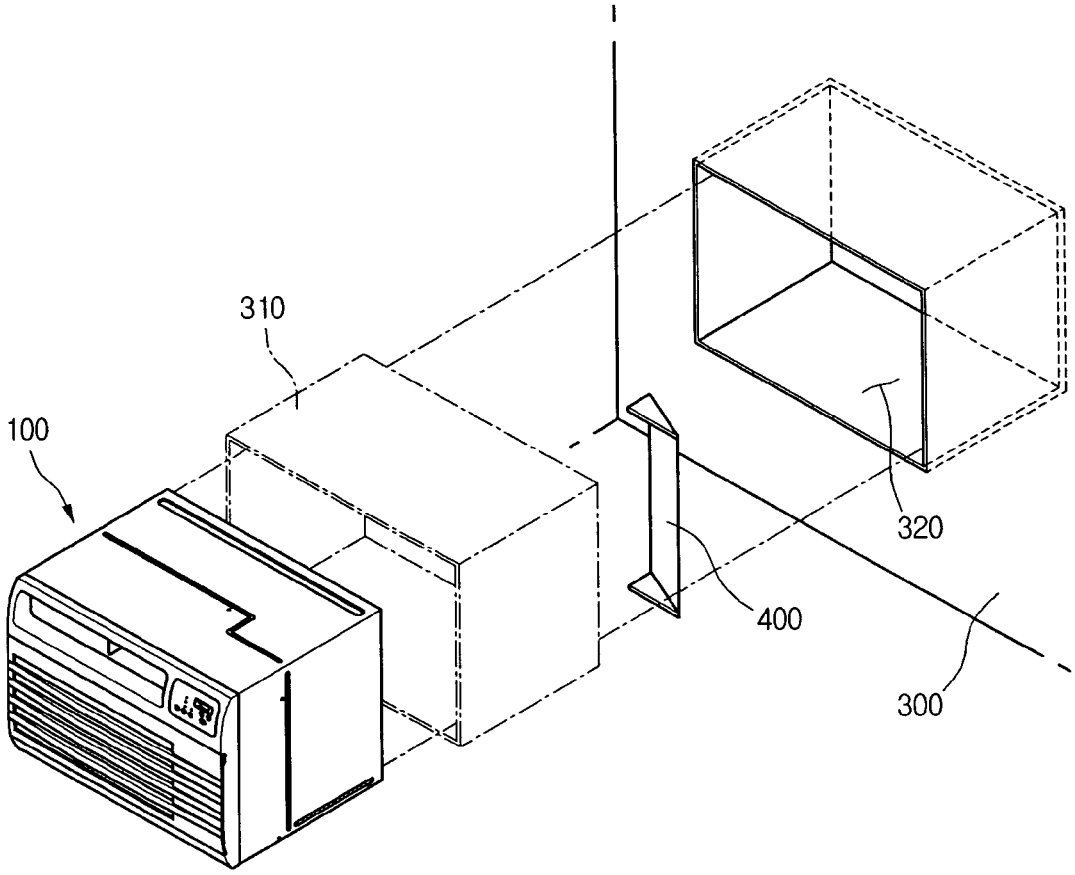
FIG. 6 is a schematic view illustrating a mounting process of a monolithic air conditioner of the present invention on an indoor-wall.

FIG. 6 shows a mounting process of the monolithic air conditioner 100 on an indoor wall;

Referring to FIG. 6, the monolithic air conditioner 100 buried in the indoor wall 300 such that the indoor and outdoor airs can be simultaneously introduced thereinto.

Describing in more detail, a receiving hole 320 is formed on the indoor wall 300 to receive the air conditioner 100. A housing 310 is inserted in the receiving hole 320 and the air conditioner 100 is mounted in the housing 310. Leakage preventing members are installed on front and rear sides of the air conditioner 100 to prevent cooked air from leaking through a gap between the air conditioner 100 and the housing 310.

A rear end of the outdoor heat exchanger 210 is spaced away from a sidewall of the cabinet 220. A gap between the cabinet 220 and the outdoor heat exchanger 210 defines the outdoor air intake. Therefore, the outdoor air is introduced into the air conditioner through the outdoor air intake. The introduced air is exhausted to the outdoor side after passing through the outdoor heat exchanger 210. In addition, as described above, the guide member 400 is mounted on a side edge of the outdoor heat exchanger 210, which is adjacent to the outdoor air intake.

Figure 7:
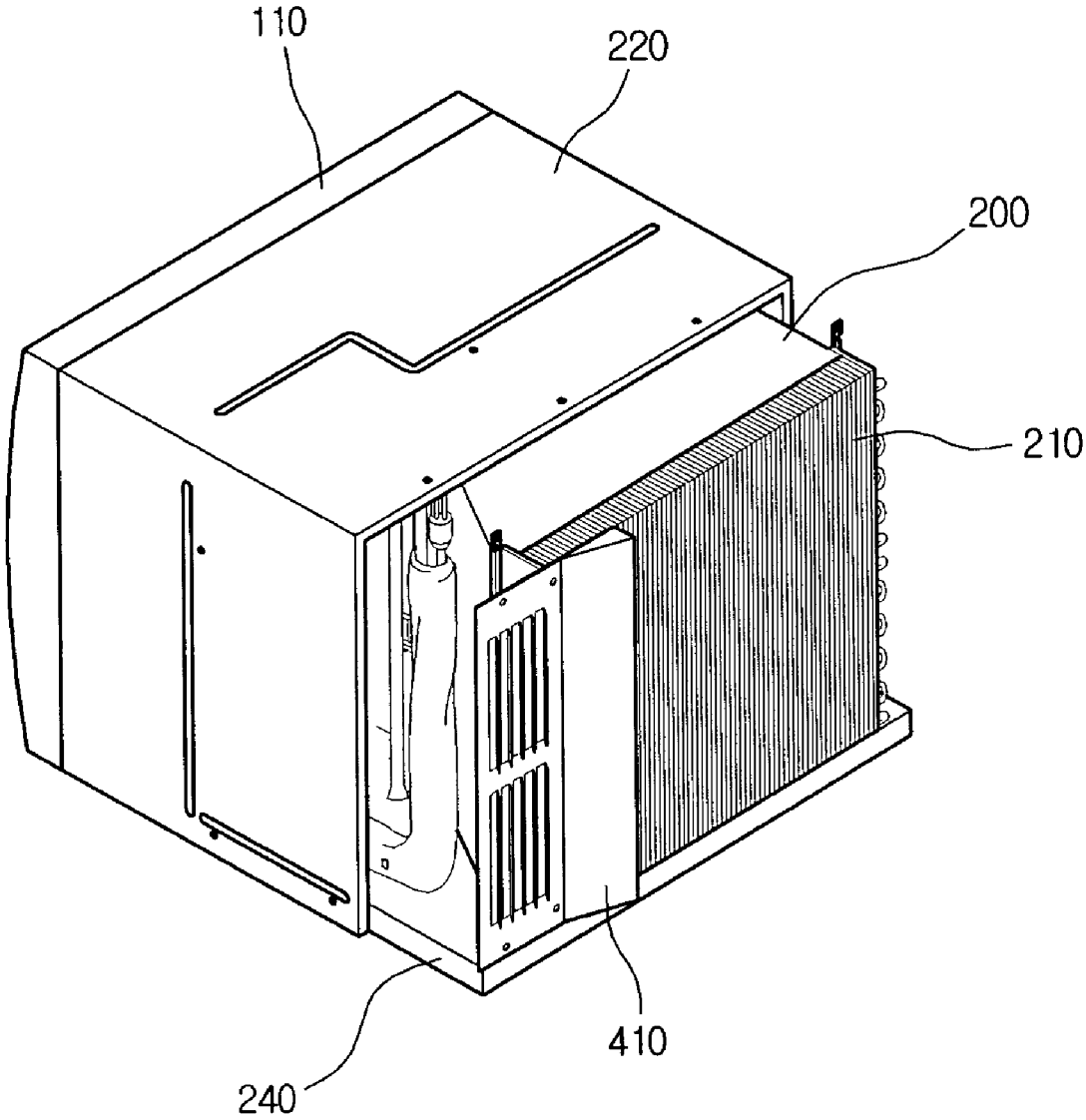
FIG. 7 is a perspective view of a monolithic air conditioner according to a second embodiment of the present invention.
Figure 8:
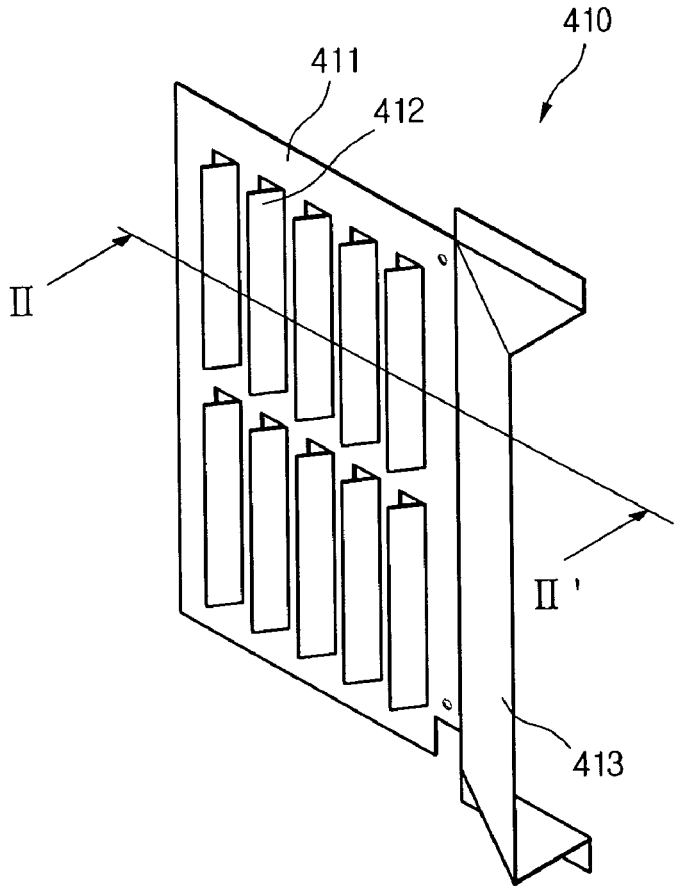
FIG. 8 is a perspective view of a guide member depicted in FIG. 7.
Figure 9:
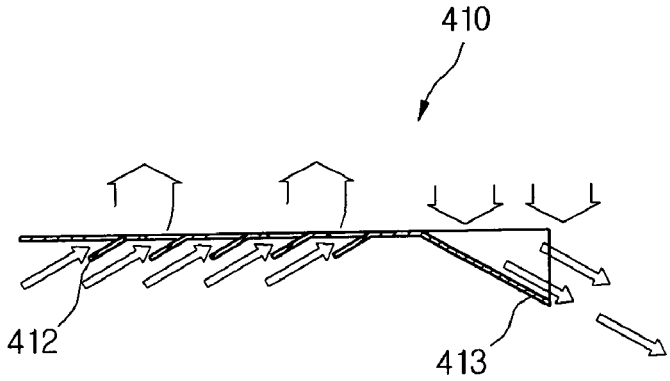
FIG. 9 is a sectional view taken along line II-II' of FIG. 4.

FIG. 7 is a perspective view of a monolithic air conditioner according to a second embodiment of the present invention, FIG. 8 is a perspective view of a guide member depicted in FIG. 7, and FIG. 9 is a sectional view taken along line II-II' of FIG. 4.

Referring to FIGS. 7 through 9, a guide member 410 of this embodiment includes a flat grill body 411, a plurality of guide fins 412, and a guide cover 413 extending from an end of the grill body 411 at a predetermined angle.

The grill body 411 is located corresponding to an outdoor air intake defined between a cabinet 220 and an outdoor heat exchanger 210 and the guide cover is attached on a rear surface of the outdoor heat exchanger 210. The grill body 411 may be designed having a size identical to or greater than the outer air intake. The guide fins 412 are formed by punching and bending a portion of the grill body 411 at a predetermined angle. The outdoor air is introduced into the air conditioner while being guided by the guide fins. After passing through the outdoor heat exchanger 210, the introduced indoor air are exhausted to the outdoor side while being guided by the guide cover 413.

Describing in more detail, inclined directions of the guide fins 412 are opposite to that of the guide cover 413. Therefore, as shown in FIG. 9, the introducing air and the exhausting air are not mixed with each other, thereby preventing the exhausting air from being reintroduced into the air conditioner. Likewise the first embodiment, upper and lower edges of the guide cover 413 are bent to prevent the leakage of the outdoor air that is being exhausted.

Figure 10:
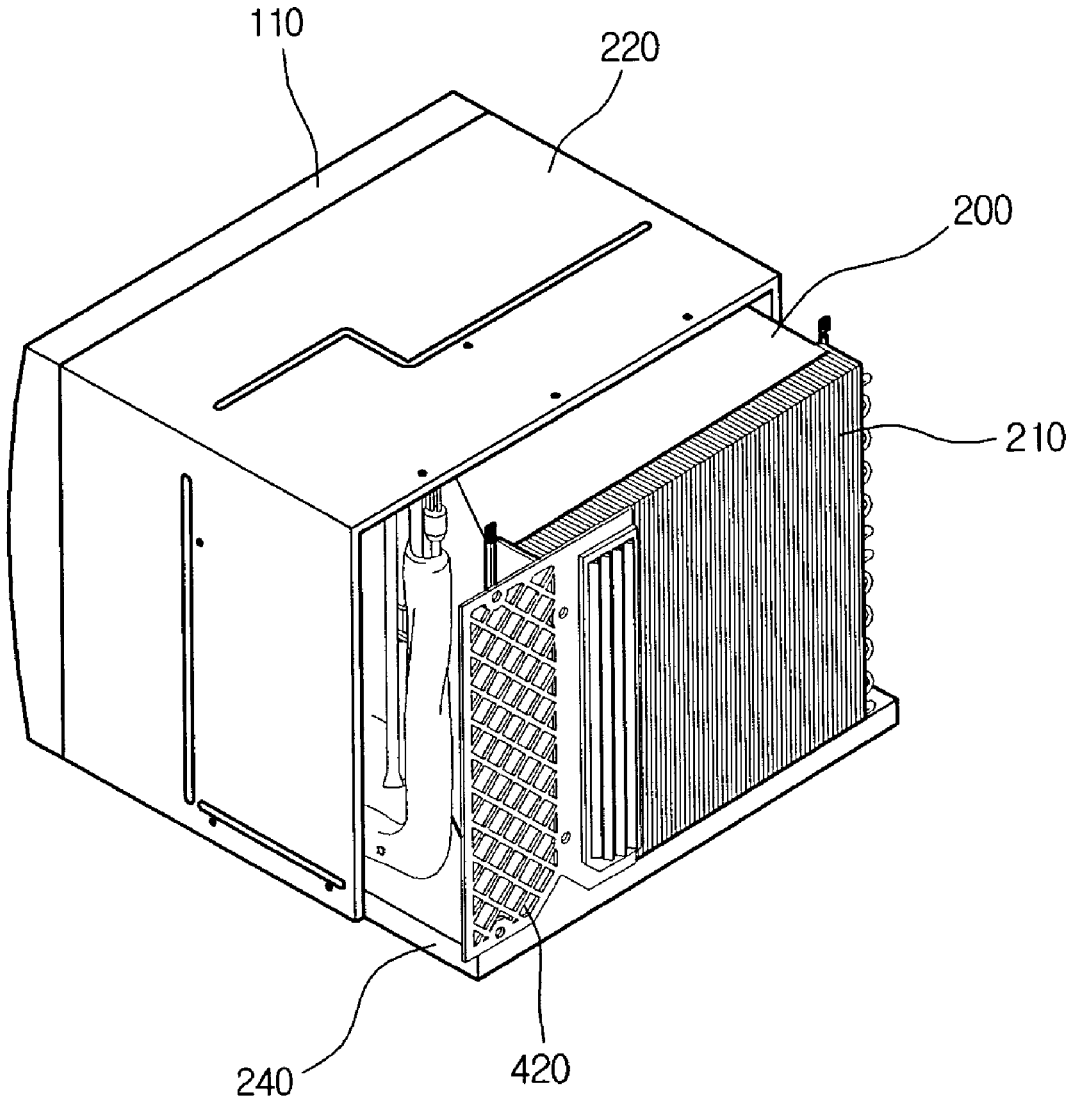
FIG. 10 is a perspective view of a monolithic air conditioner according to a third embodiment of the present invention.
Figure 11:
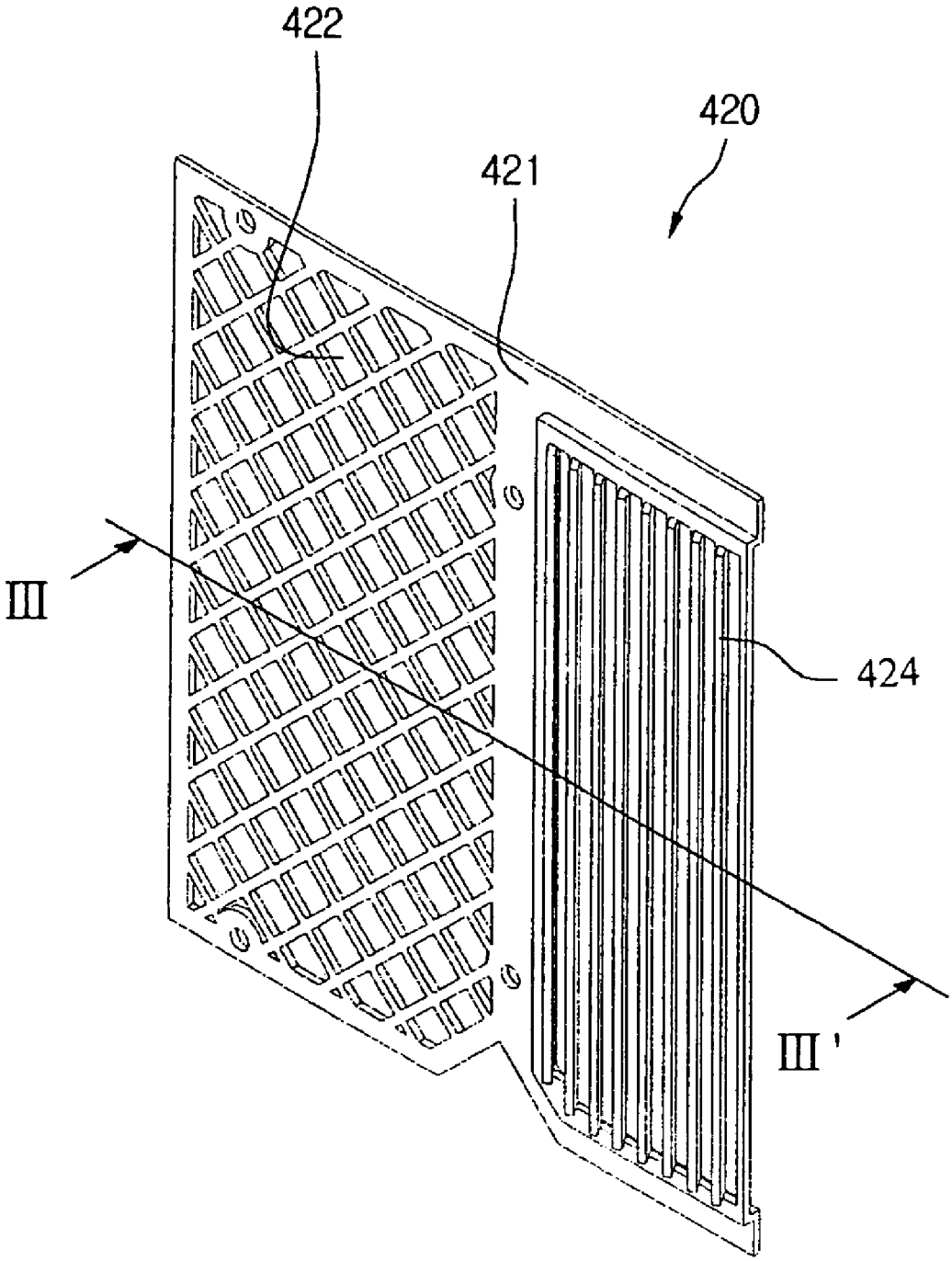
FIG. 11 is a perspective view of a guide member depicted in FIG. 10.
Figure 12:
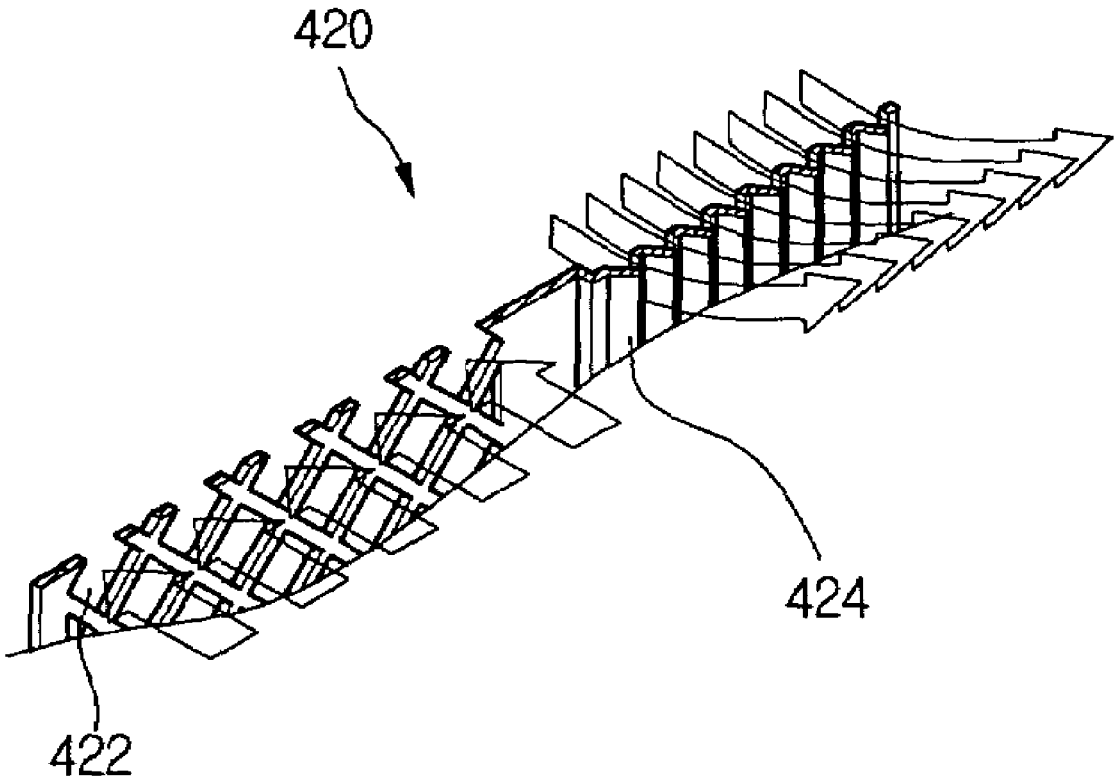
FIG. 12 is a sectional view taken along line III-III' of FIG. 11.

FIG. 10 is a perspective view of a monolithic air conditioner according to a third embodiment of the present invention, FIG. 11 is a perspective view of a guide member depicted in FIG. 10, and FIG. 12 is a sectional view taken along line III-III' of FIG. 11.

Referring to FIGS. 10 through 12, a guide member 420 of this embodiment includes a rectangular base plate 421. An air intake section 423 and an air outlet section 425 are formed on the base plate 421.

A plurality of air intake holes 422 are formed in a lattice-work on the air intake section 423. A plurality of guide fins 242 are formed on the air outlet section 425. The guide fins 424 are inclined at a predetermined angle such that the air can be exhausted in a direction away from the air intake section 423. It is preferably that the air intake holes 422 are designed having a size disallowing a finger of a child to be inserted therethrough. It is also preferable that each of the guide fins 424 is formed extending from an upper end to a lower end of the base plate 421.

A plurality of coupling holes are formed on an edge of the base plate 421 or a boundary portion between the air intake section 423 and the air outlet section 425 so that the guide member 420 can be coupled to the outdoor heat exchanger 210 by a coupling member.

Meanwhile, the air intake section 423 is disposed corresponding to the outdoor air intake of the air conditioner 100 and the air outlet section 425 is disposed on a rear surface of the outdoor heat exchanger 210.

Accordingly, the outdoor air is introduced into the air conditioner 100 through the air intake holes 422 of the air intake section 423. After passing through the outdoor heat exchanger 210, the introduced air is exhausted to the outdoor side while being guided by the guide fins 424 to a direction not to be mixed with the outdoor air that is being introduced.

Since the air intake section 423 is located corresponding to the outdoor air intake, the injury of the children can be prevented and the introduction of the large volume foreign objects through the outdoor air intake can be prevented.

It will be apparent to those skilled in the art that various modifications and variations can be made in the present invention. Thus, it is intended that the present invention covers the modifications and variations of this invention provided they come within the scope of the appended claims and their equivalents.

For example, the air intake section of the third embodiment may be formed extending from the mounting section 401 of the first embodiment. In addition, the grill body 411 and the guide fins 412 that are proposed in the second embodiment may be replaced with the air intake sections 423 of the third embodiment.

What is claimed is:

1. A monolithic air conditioner comprising:

a cabinet of which a part placed in an indoor space is defined as a front part and another part placed in an outdoor space is defined as a rear part;

a first heat exchanger mounted on a front-inner portion of the cabinet, the first heat exchanger contacting indoor air in both cooling and heating modes;

a first guide member located at an end of the front part of the cabinet, the first guide member having a front grille to allow indoor air to be introduced into the air conditioner, an air outlet to allow indoor air having exchanged heat by passing through the first heat exchanger to be discharged into the indoor space;

a second heat exchanger mounted on a rear-inner portion of the cabinet and spaced away from a sidewall of the cabinet to define an outdoor air intake, the second heat exchanger contacting outdoor air in both the cooling and heating modes;

a second guide member located at an end of the rear part of the cabinet, the second guide member comprising:

a mounting section mounting the second guide member to the second heat exchanger, an inclined section extending from the mounting section at a predetermined inclined angle to prevent the outdoor air discharged after passing through the second heat exchanger from being mixed and re-introduced into the cabinet, and guide sections formed by bending upper and lower edges of the inclined section; and a fan assembly disposed between the second heat exchanger and the first heat exchanger, wherein the cabinet is configured in such a manner that outdoor air is parallelly introduced and exhausted in a front-to-rear direction of the air conditioner, and wherein the inclined section is inclined in a direction that the outdoor air can be exhausted in a direction away from the outdoor air intake.

2. The monolithic air conditioner according to claim 1, wherein the second guide member has a length corresponding to a length between upper and lower ends of the second heat exchanger.

3. The monolithic air conditioner according to claim 1, wherein the second guide member is mounted on an edge of the second heat exchanger, which is adjacent to the outdoor air intake that is defined between the sidewall of the cabinet and the second heat exchanger.

4. The monolithic air conditioner according to claim 1, wherein the second guide member further comprises a grille body extending from an end of the mounting section to correspond to the outdoor air intake; and a plurality of guide fins formed by punching and bending a portion of the grille body at a predetermined angle.

5. The monolithic air conditioner according to claim 4, wherein the grille body is designed having a size identical to or greater than that of the outdoor air intake.

6. The monolithic air conditioner according to claim 4, wherein inclined directions of the guide fins are opposite to that of the inclined section.

7. The monolithic air conditioner according to claim 1, wherein the second guide member further comprises an air intake section extending from the coupling section to be disposed corresponding to the outdoor air intake, and the air intake section is provided with a plurality of air intake holes.

8. The monolithic air conditioner according to claim 7, wherein the air intake holes are formed in a latticework.

9. The monolithic air conditioner of claim 1, wherein the second guide member directly contacts the second heat exchanger.

10. The monolithic air conditioner of claim 1, wherein the second guide member has a smaller width than the second heat exchanger.

11. The monolithic air conditioner of claim 1, further comprising a shroud extending between the second heat exchanger and the cabinet.

* * * * *